US005096245A

United States Patent [19]

Kikuchi et al.

[11] Patent Number: 5,096,245

[45] Date of Patent: Mar. 17, 1992

[54] PACKAGE PALLETIZING SYSTEM

[75] Inventors: Shuichi Kikuchi, Shiga; Takenori Yanai, Inuyama, both of Japan

[73] Assignee: Murata Kikai Kabushiki Kaisha, Kyoto, Japan

[21] Appl. No.: 561,320

[22] Filed: Aug. 1, 1990

Related U.S. Application Data

[62] Division of Ser. No. 490,140, Mar. 7, 1990.

[30] Foreign Application Priority Data

Mar. 10, 1989 [JP] Japan ..... 1-27408[U]
Mar. 10, 1989 [JP] Japan ..... 1-59068

[51] Int. Cl.[5] ..... B66C 1/54; B66C 1/62

[52] U.S. Cl. ..... 294/87.1; 294/81.62; 53/247

[58] Field of Search ..... 53/446, 143, 247, 249, 53/473, 539, 149-157, 251, 539, 543, 544; 294/2, 94, 99.1, 81.6, 81.62, 87.1, 87.24, 87.22, 31.1, 88.8, 90, 106

[56] References Cited

U.S. PATENT DOCUMENTS

| | | | |
|---|---|---|---|
| 1,564,655 | 12/1925 | Westbo | 294/81.52 |
| 1,790,761 | 2/1931 | Ortolon | 294/94 |
| 3,302,967 | 2/1967 | Harris et al. | 294/87.1 X |
| 3,648,427 | 3/1972 | Raudat et al. | 53/247 X |
| 3,780,492 | 12/1973 | Corderoy | 294/87.1 X |
| 3,948,018 | 4/1976 | Rowekamp | 53/247 X |
| 4,043,097 | 8/1977 | Ishida et al. | 53/247 X |
| 4,373,755 | 2/1983 | Herberholz et al. | 294/81.52 X |
| 4,498,573 | 2/1985 | Anderson et al. | 294/87.1 X |
| 4,686,813 | 8/1987 | Sawada | 53/247 X |
| 4,731,977 | 3/1988 | Maekawa | 53/247 X |

FOREIGN PATENT DOCUMENTS

| | | | |
|---|---|---|---|
| 3336930 | 4/1985 | Fed. Rep. of Germany | 294/87.1 |
| 632637 | 11/1978 | Switzerland | 294/87.1 |
| 971647 | 11/1982 | U.S.S.R. | 294/87.1 |
| 1481187 | 5/1989 | U.S.S.R. | 294/99.1 |
| 1482877 | 5/1989 | U.S.S.R. | 294/87.1 |

*Primary Examiner*—Frank E. Werner
*Assistant Examiner*—Brian Dinicola
*Attorney, Agent, or Firm*—Spensley Horn Jubas & Lubitz

[57] ABSTRACT

A package palletizing system is systematized such that it comprises a winder, an inspection station for inspecting cone packages wound up by the winder, and a palletizing station for palletizing the cone packages after inspection in alternately opposite postures, and that feeding of cone packages from the winder to the inspection station is carried out by means of an overhead self-travelling truck while feeding of cone packages from the inspection station to the palletizing station and loading of the same are carried out by means of the overhead self-travelling truck.

1 Claim, 12 Drawing Sheets

PACKAGE PALLETIZING SYSTEM

This is a division of application Ser. No. 07/490,140, filed on Mar. 7, 1990.

FIELD OF THE INVENTION

This invention relates to a package palletizing system for automatically stacking cone packages wound up by a winder.

RELATED ART STATEMENT

When packages wound up by a winder are to be palletized, where they have a cone-like shape, if packages of an erect posture and packages of an inverted posture are inserted in an alternate relationship, then they can be filled densely and the stacked condition can be stabilized. In this instance, part of cone packages being fed in an erect posture must necessarily be turned over to change the posture thereof into an inverted posture.

Conventionally, such operation normally relies upon a hand of an operator, but this forces a severe labor upon the operator Thus, a boxing robot for cone packages which carries a turning over device is proposed as an automatic apparatus for the exclusive use in the official gazette of Japanese Patent Laid-Open No. 61-217321.

Meanwhile, as a system for inspecting cone packages wound up by a winder and then packaging and forwarding the cone packages, an automatic transporting system wherein a series of such operations can be carried out automatically is proposed in the official gazette of Japanese Patent Laid-Open No. 62-39434.

However, the systems proposed in the individual official gazettes described above are required to include, in any way, a feeding means for feeding cone packages wound up by a winder to an inspecting station, another feeding means for feeding cone packages after inspection from the inspection station to a palletizing station, and a loading means (boxing robot) at the palletizing station for loading cone packages in a predetermined arrangement. In short, two independent package feeding lines and a palletizing means are necessitated.

However, it cannot be avoided that construction of the entire system is complicated.

OBJECT AND SUMMARY OF THE INVENTION

Taking such technical background as described so far into consideration, the present invention develops and provides a rational palletizing system wherein an overhead self-travelling truck for mounting, suspending and feeding cone packages serves both as a package feeding means for the entire system and as a palletizing means.

A package palletizing system proposed by the present invention is systematized such that it comprises a winder, an inspection station for inspecting cone packages wound up by the winder, and a palletizing station for palletizing the cone packages after inspection in alternately opposite postures, and that feeding of cone packages from the winder to the inspection station is carried out by means of an overhead self-travelling truck while feeding of cone packages from the inspection station to the palletizing station and loading of the same are carried out by means of the overhead self-travelling truck.

With the palletizing system of the present invention, making use of an idle time while the overhead self-travelling truck intermittently feeds cone packages from the winder to the inspecting station, cone packages after inspection are fed from the inspecting station to the palletizing station and loaded in a stack in alternately opposite postures onto a pallet at the palletizing station by the overhead self-travelling truck.

DETAILED DESCRIPTION OF PREFERRED EMBODIMENTS

Figure 1:
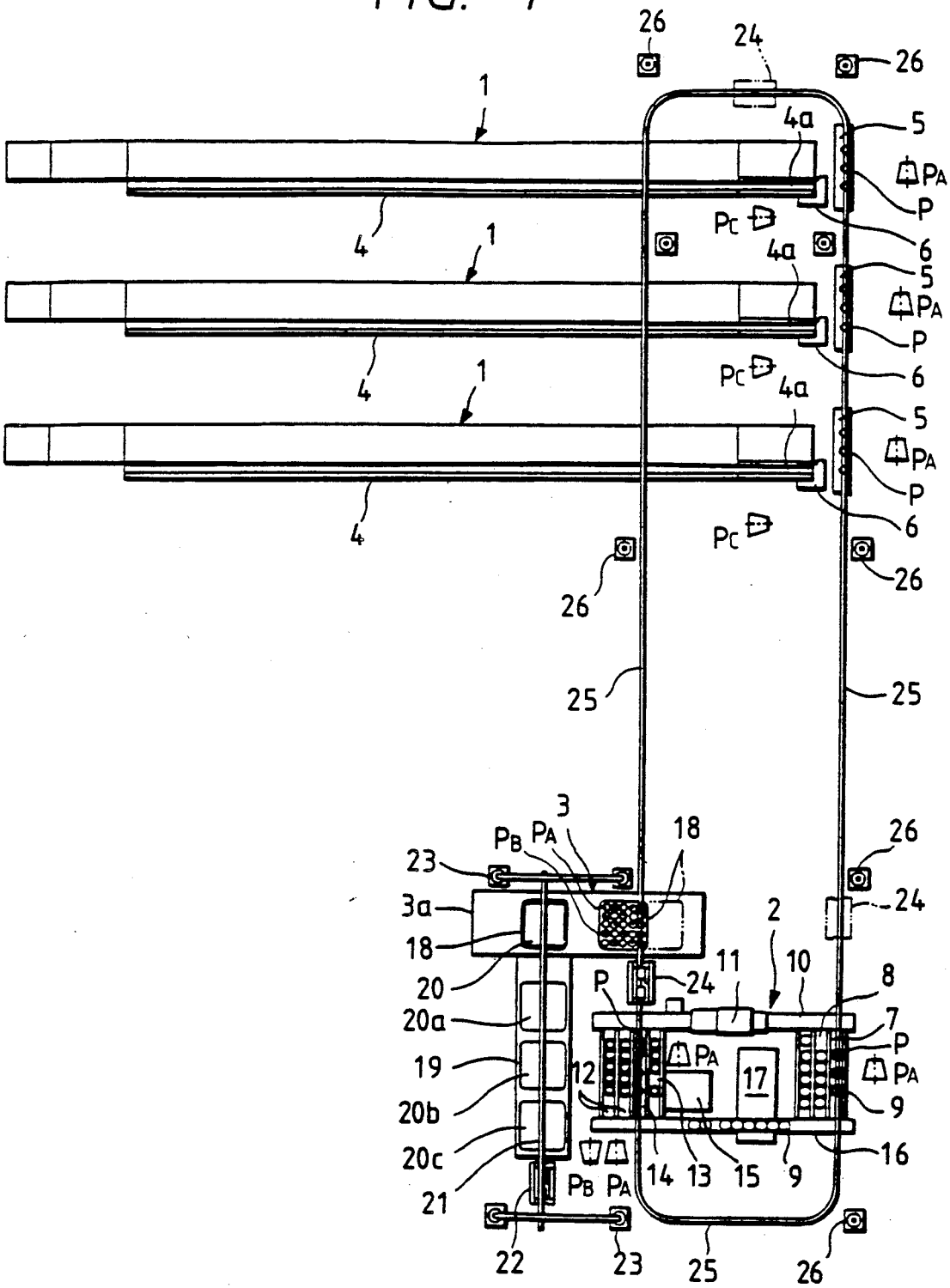
FIG. 1 is a plan view of a package palletizing system showing an embodiment of the present invention.

In the following, an embodiment of the present invention shown in the drawings will be described.

FIG. 1 shows a layout of a package palletizing system according to the present invention.

Figure 2:
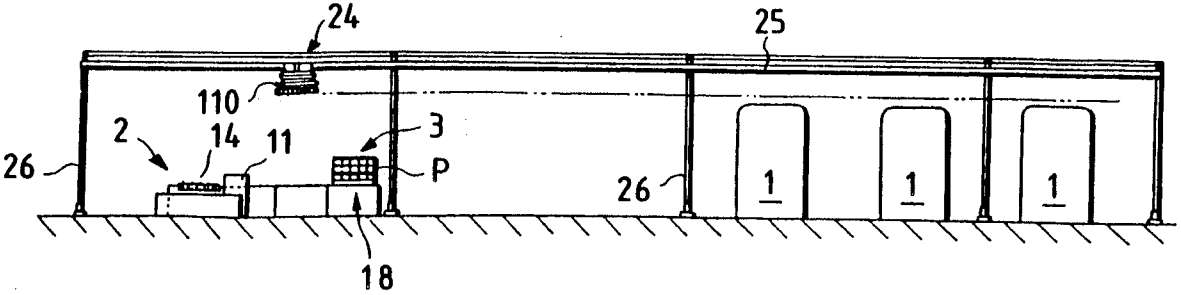
FIG. 2 is a side elevational view of the same.
Figure 3:
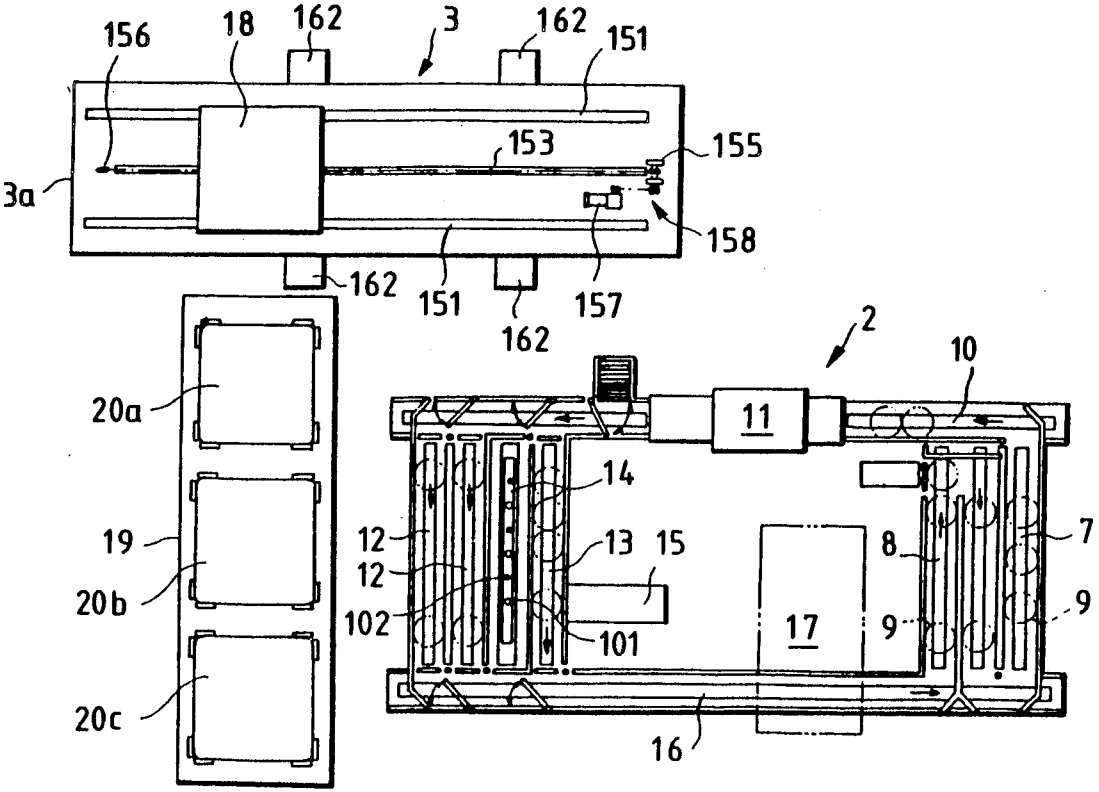
FIG. 3 is a partial enlarged view of FIG. 1.

An outline of the present system will be described with reference to FIGS. 1 to 3.

In the present system, automatic winders 1 each including winding units disposed in a juxtaposed relationship are provided in a row on one side of a floor. Meanwhile, disposed on the opposite side are an inspecting station 2 for inspecting cone packages P wound up by the individual winders 1 and a palletizing station 3 for palletizing packages P after inspection and transporting or forwarding them to a next step.

Each of the winders 1 includes a conveyor 4 disposed in a juxtaposed relationship for conveying doffed cone packages P, and in this instance, packages P are transported on the conveyor 4 in a forwardly inclined horizontally lying posture Pc wherein the smaller diameter sides thereof are directed forwardly.

In the neighborhood of a conveyor carrying out end 4*a* of each of the winders 1, an aligning conveyor 5 is disposed in a perpendicular direction for fitting packages P transported thereto on the conveyor 4 onto pegs in an erect posture $P_A$ to align the cone packages P at in a spaced relationship by a predetermined distance (coincident with a package loading pitch upon palletizing).

Then, in order to allow such orienting and transferring operation of the cone packages P to be carried out smoothly, a package transferring device 6 is interposed between the conveyor carrying out end 4*a* and the aligning conveyor 5.

Meanwhile, a carrying in conveyor 7 is provided at the inspecting station 2 for carrying in cone packages P suspended on and fed by an overhead self-travelling truck which will be hereinafter described from the aligning conveyors 5. Trays 9 are successively supplied to the carrying in conveyor 7 from an adjacent stock conveyor 8 as shown in FIG. 3 so that a number of such trays 9 corresponding to the number of cone packages P to be received may stand by on the conveyor 7. Then, after cone packages P fed from the winder 1 side are implanted onto the trays 9, the trays 9 are successively carried out to a conveyor 10 provided in a contiguous relationship to the carrying in conveyor 7 and undergo inspection of the packages P by an inspecting device 11 provided intermediately of the conveyor 10.

Cone packages 9 after inspection are successively transported, except those which are to be fed from the conveyor 10 to stock conveyors 12 for warper creel packages, to a stock conveyor 13 for feeding the cone packages P to the palletizing station 3. Cone packages P transported in an erect posture $P_A$ to the stock conveyor 13 are removed, while maintaining their posture at a certain step but being reversed into an inverted posture $P_B$ at a next step, to pegs 101 (or 102) implanted on an aligning conveyor 14 provided at an adjacent location. Such removing operation is carried out smoothly by a package removing device 15 disposed adjacent the stock conveyor 13. It is to be noted that empty trays 9 discharged from the stock conveyors 12 and 13 are transported by a feedback conveyor 16 and returned to the stock conveyor 8. A cleaning device 17 is disposed for the feedback conveyor 16 if necessary.

Subsequently, the palletizing station 3 is disposed adjacent the winder 1 side of the inspecting station 2. The palletizing station 3 is substantially constituted from a pallet placing truck 18 disposed for movement in a direction perpendicular to the direction of travelling movement of an overhead self-travelling truck which will be hereinafter described The truck 18 includes a necessary self-travelling mechanism, and pallets 20 are successively transferred to the track 18 from a pallet placing table 19 disposed adjacent and in parallel to the inspecting station 2. The truck 18 includes a positioning stopping mechanism which can achieve accurate positioning at individual loading positions in order to load a pallet 20 onto the truck 18 and load cone packages P onto the pallet 20 In particular, at an extension position of the pallet placing table 19, a pallet 20 (a bottom plate 20*a*, a partition plate 20*b* and a lid plate 20*c*) placed on the placing table 19 is loaded while at an extension position of the aligning conveyor 14, cone packages P fed from the aligning conveyor 14 are loaded in alternately opposite postures. Then, after the packages P are stacked in a predetermined number of stacks on the pallet 20 by way of the partition plate 20*b*, the cone packages P are forwarded in a stacked condition from a rear end 3*a* of the palletizing station 3.

It is to be noted that a transferring operation of a pallet 20 to the truck 18 is carried out by causing the pallet 20 to be suspended on and fed by an overhead travelling truck 22 which travels along an overhead rail 21 disposed at an upper location. Reference numeral 23 denotes a support post for the rail 21.

Above the group of the winders 1, inspecting station 2 and palletizing station 3 disposed in such a manner as described above, an overhead self-travelling truck 24 which serves as a feeding means for cone packages P and also as a palletizing means in the present system is caused to travel.

To this end, an overhead rail 25 which serves as a travelling rail for the overhead self-travelling truck 24 extends from a location just above the aligning conveyors 5 on the winder 1 side to another location just above the carrying in conveyor 7 at the inspecting station 2 and further extends from the carrying in conveyor 7, past a location just above the aligning conveyor 14 of the same station 2, to the package loading position of the palletizing station 3. Then, in the case of the present embodiment, the rail 25 is closed in a closed loop so that the overhead self-travelling truck 24 may travel in a circuit on the rail 25. Reference numeral 26 denotes a support post for the rail 25.

The overhead self-travelling truck 24 which is utilized in the present invention has a chuck device carried thereon for mounting a cone package P onto a lifting table 110 which depends for up and downward movement from a truck body. The chuck device has a function which can mount a plurality of cone packages P arranged in a row at a predetermined pitch on an aligning conveyor 5 or the aligning conveyor 14 in their postures whether the fitted postures thereof are erect postures or inverted postures.

In the case of the present embodiment, however, by means of the single overhead self-travelling truck 24 wherein the chuck described above is carried on the lifting table 110, cone packages P aligned in an erect posture $P_B$ on the aligning conveyors 5 are fed to the carrying in conveyor 7 of the inspecting station 2, and then cone packages P aligned either in an erect posture or in an inverted posture on the aligning conveyor 14 of the same station 2 are fed onto the truck 18 of the palletizing station 3 so that a stacking operation may be carried out wherein the cone packages P are loaded in alternately opposite postures on a pallet 20.

An example of package palletizing by the system described above is such as follows.

Figure 4:
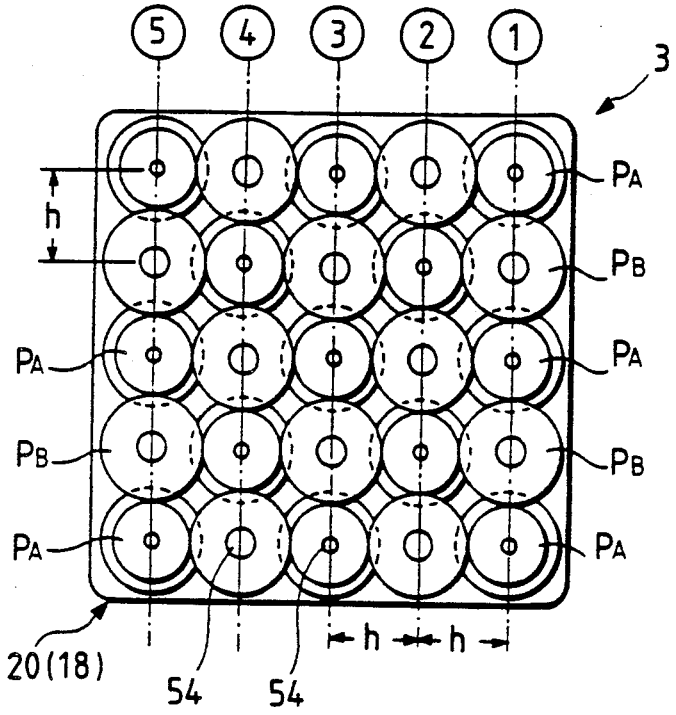
FIG. 4 is a plan view showing an example of palletizing method of cone packages on a pallet.

FIG. 4 shows a case wherein cone packages P are stacked by $5\times5$ (rows) $=25$ (units) for each stage in alternately opposite postures. In this instance, after cone packages P are fed to the inspecting station 2, at first three such cone packages P of an erect posture $P_A$ are mounted and suspended at a predetermined pitch on the overhead self-travelling truck 24 circulating above the aligning conveyor 14, and then, they are loaded in a right end first row (1) of a pallet 20 on the truck 18. At a next step, the pallet 20 is intermittently moved rightwardly by a loading pitch h of cone packages P together with the truck 18, and two of the cone packages P which are of an inverted posture $P_A$ are mounted on the overhead self-travelling truck 24 and are loaded in a second row (2) in an alternate relationship to the preceding cone packages P. After such a procedure is repeated until the cone packages P of an erected posture $P_A$ are loaded to a left end fifth row (5) (a sum total of 13 units), now the truck 18 is intermittently fed reversely while the cone packages P of an inverted posture $P_B$ are mounted away from the aligning conveyor 4 and suspended on and fed by the overhead self-travelling truck 24. Thus, the cone packages P are loaded successively from the fifth row (5). In this instance, the quantity of inverted packages to be carried on the overhead self-travelling truck 24 is two where the number of erected packages described above is three but is three where the number of erected packages is two. In either case, however, the inverted packages are loaded in an accurately positioned relationship between the erected packages. Thus, by loading the cone packages P of an inverted posture $P_B$ from the fifth row (5) to the first row (1) (a sum total of 12 units), dense filling of the cone packages P having no clearance among them is realized on the pallet 20. After then, cone packages P are stacked in a required number of stages with a partition plate **20*b*** interposed between the individual stages.

While the palletizing described above is naturally an example and other various loading procedures can be adopted, in any case, it is a maximum characteristic that, if a system according to the present invention is utilized, then dense and stabilized loading desired for cone packages P can be put into practice making use of the overhead self-travelling truck 24 for the feeding of packages P.

In the following, details of individual system elements which assure smooth operation of the palletizing system shown in the embodiment will be described.

Package Transferring Device

The package transferring device 6 installed at the package carrying out end **4*a* of each of the winders 1** is constructed in the following manner.

Figure 5:
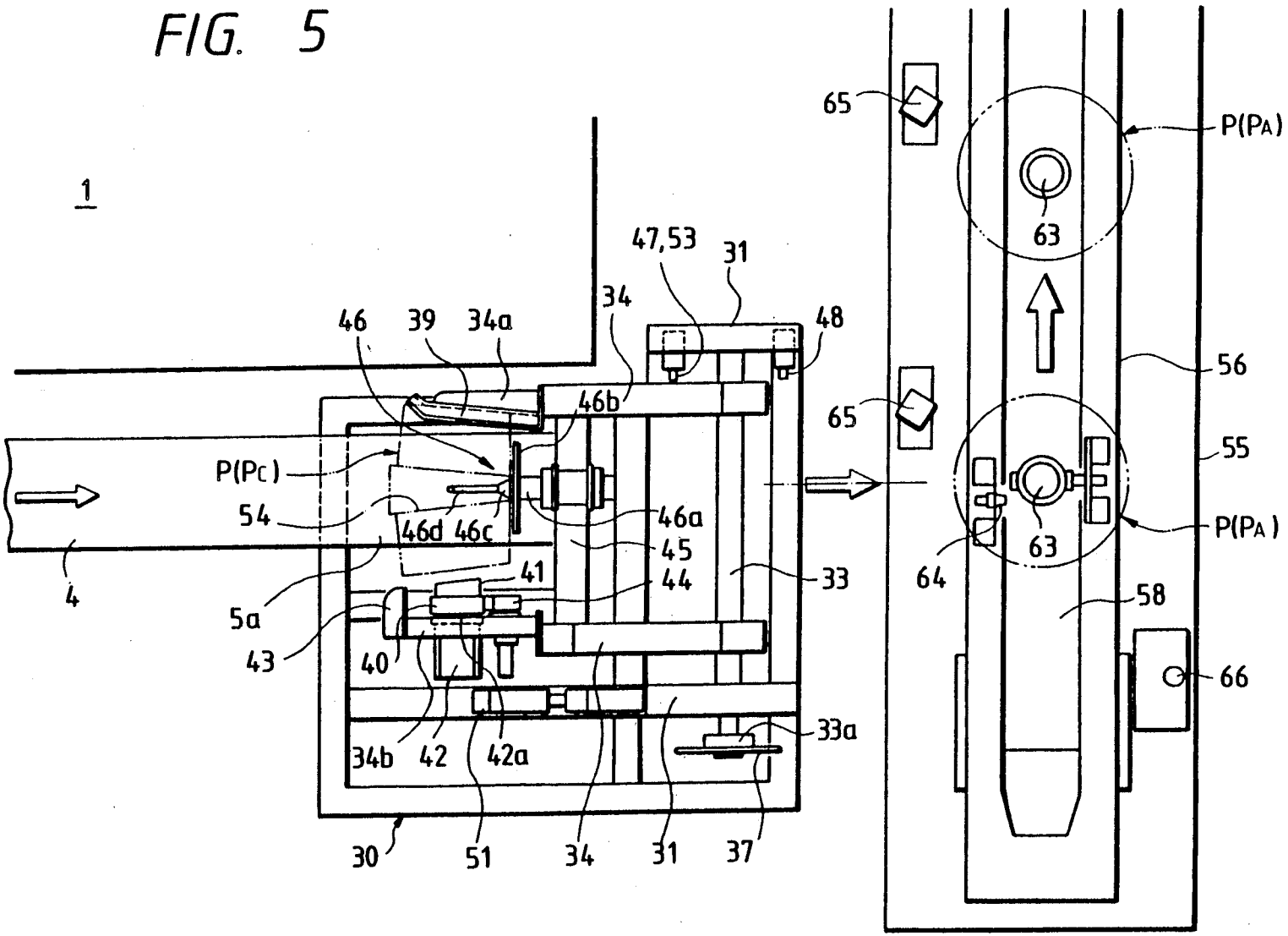
FIG. 5 is a plan view showing a package transferring device.
Figure 6:
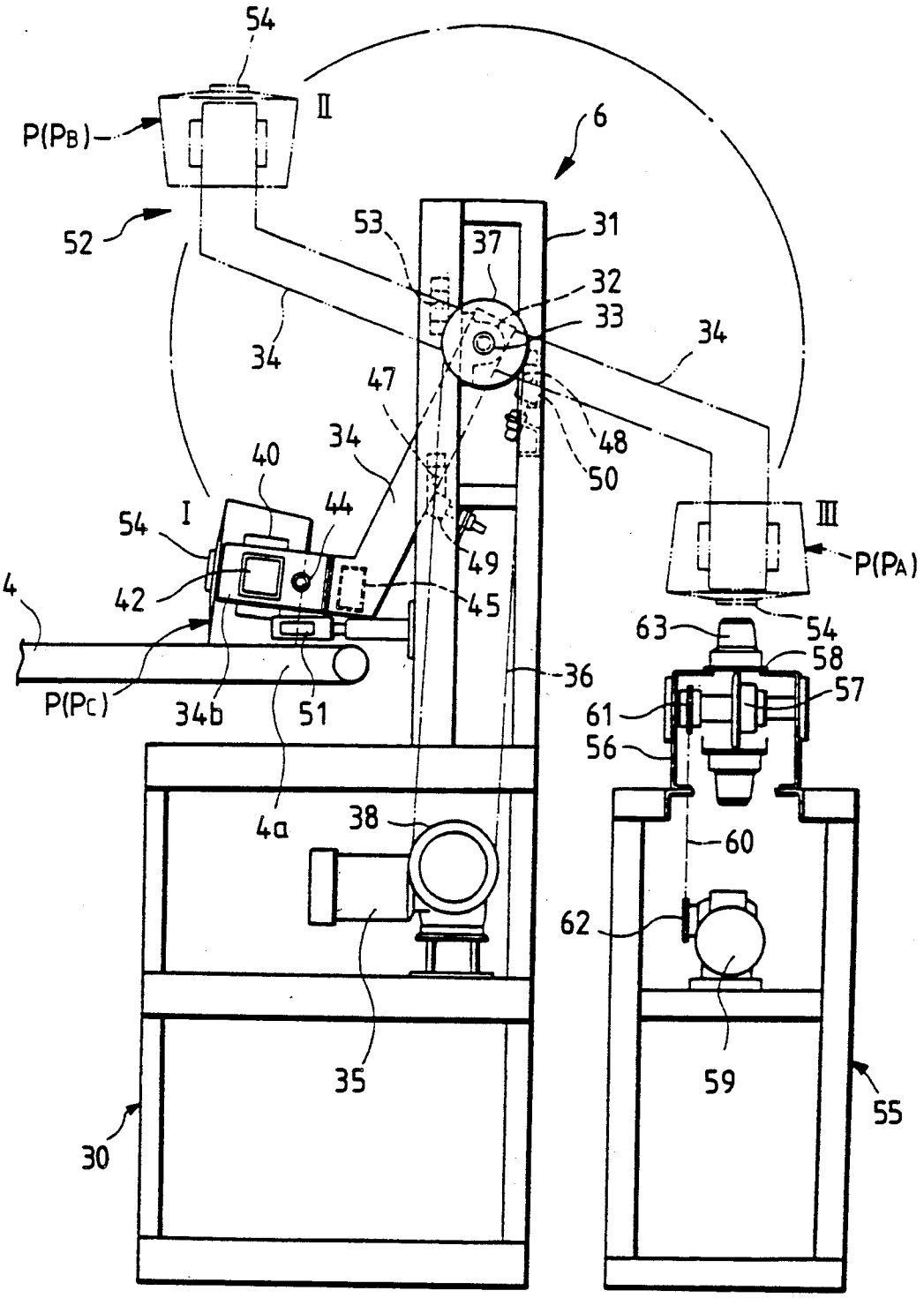
FIG. 6 is a side elevational view of the same.

FIGS. 5 and 6 show details of the package transferring device 6.

The present device is constructed such that a base 30 is disposed below the carrying out end **4*a* of the conveyor 4 provided in a juxtaposed relationship with the winder 1, that a pair of frames 31 and 31 are provided uprightly from the base 30 and disposed on the opposite sides of the conveyor 4, that a pivotal shaft 33 is supported for rotation by way of a bearing 32 above the frames 31 and 31, and that a pair of arms 34 and 34 are provided in a juxtaposed relationship for vertical pivotal motion in a predetermined spaced relationship with a base end portion of each of the arms 34 and 34 supported for rotation on the pivotal shaft 33. The arms 34 and 34 are constructed such that they can be pivoted vertically within an angular range of about 270 degrees, in the case of the present embodiment, from the conveyor 4 side to the opposite side across the frames 31 by a power transmitted from a motor 35 accommodated in the base 30 to a driving end 33*a* of the pivotal shaft 33 extending sidewardly from a side of a frame 31 by way of a chain-and-sprocket mechanism 36, 37 and 38**.

Chuck supporting arms **34*a* and 34*b* bent substantially in an L-shape are connected to end portions of the arms 34 and 34. The supporting arms 34*a* and 34*b* coincide, in a standby posture shown in solid lines in FIG. 6, in posture with an axial line of a cone package P transported thereto on the conveyor 4. Then, a fixed chuck member 39 is fixedly provided on one 34*a* of the chuck arms. The fixed chuck member 39** is curved arcuately and tapered in a longitudinal direction so as to fit with an outer conical peripheral face of a cone package P transported thereto in a forwardly inclined horizontally lying posture.

Meanwhile, the other chuck supporting arm **34*b* has fixedly provided at a location thereof opposing to the fixed chuck member 39 a movable chuck member 40 on which a pair of chuck pieces 41 are fixedly mounted The individual chuck pieces 41 are disposed in a suitable spaced relationship from each other and are each chamfered at an end thereof while each of them has a taper in a longitudinal direction corresponding to a cone package P. The movable chuck member 40 is connected to a cylinder rod 42*a* of a cylinder 42 provided in a juxtaposed relationship on the outer side of the chuck supporting arm 34*b* so that it may be operated to open and close at a fixed stroke with respect to the opposing fixed chuck member 39 by expanding and contracting motion of the rod 42*a***.

It is to be noted that reference numeral 43 denotes a cover member provided at an end of the chuck supporting arm **34*b*. Meanwhile, reference numeral 44 denotes a guide member provided on the chuck supporting arm 34*b* in the neighborhood of the movable chuck member 40**.

The arrangement of the chuck members 39 and 40 described above is such that, as shown in FIG. 5, the fixed side is located proximate to the conveyor 4 while the movable side is spaced away from the fixed side by a distance corresponding to the stroke of the opening and closing motion.

Meanwhile, at end portions of the arms 34 and 34 to which the chuck supporting arms **34*a* and 34*b* are connected, a supporting frame 45 for interconnecting them in an integral relationship is provided. Then, at a location of the support frame 45 adjacent the fixed chuck member 39, or more particularly at a location coincident with a center line of the conveyor 4, the support frame 45 has a fitting support member 46 provided projectingly thereon in parallel to the arms 34 and 34. The fitting support member 46 is composed of a base shaft portion 46*a* on the fixed side, a disk portion 46*b* secured to an end of the base shaft portion, a cone portion 46*c* connecting to the top of the disk portion 46*b*, and a pin portion 46*d* extending from an end of the cone portion 46*c*. The fitting support member 46 plays a role to center, with the pin portion 46*d* at an end thereof fitted in an axial hole 54 of a package P, the axial line of the cone package P with respect to the fitting support member 46 which is positioned on the axes of the chuck members 39 and 40** on the opposite sides.

The arms 34 and 34 having such construction as described above are pivoted back and forth within the angular range described above between a standby position (package mounting position) I of FIG. 6 and a transfer position III on the opposite side across the frame 31 each time a cone package P is to be transferred To this end, corresponding to such positions, non-contact sensors 47 and 48 for detecting the pivoted positions of an arm 34 and stoppers 49 and 50 for stopping rotation of the arm 34 are provided on one side of the frame 31. It is to be noted that reference numeral 51 denotes a sensor disposed in the neighborhood on the outside of the movable chuck member 40 and adapted to detect that a cone package P on the conveyor 4 has arrived at the mounting position I.

The package transferring device 6 includes, in addition to such construction as described above, a re-grasping mechanism 52 for re-grasping a cone package P intermediately in a locus of pivotal motion of the same. The re-grasping mechanism 52 is constructed, in this instance, making use of a non-contact sensor 53 provided at a symmetrical location on the frame 31 to the non-contact sensor 48. In particular, the re-grasping mechanism 52 is systematized such that, when the arms 34 are pivoted to an intermediate position II (position turned over by 180 degrees from the transfer position III) to which a package P held by and grasped between the arms 34 is changed in posture to a substantially inverted posture $P_B$, the non-contact sensor 53 detects the arrival of the arm 34, and in response to this, the motor 35 is switched off, and then in the stopping condition, the cylinder 42 is operated to open and close. It is to be noted that such a sequence of operations as described above is carried out making use of electric control or microcomputer control.

Figure 7:
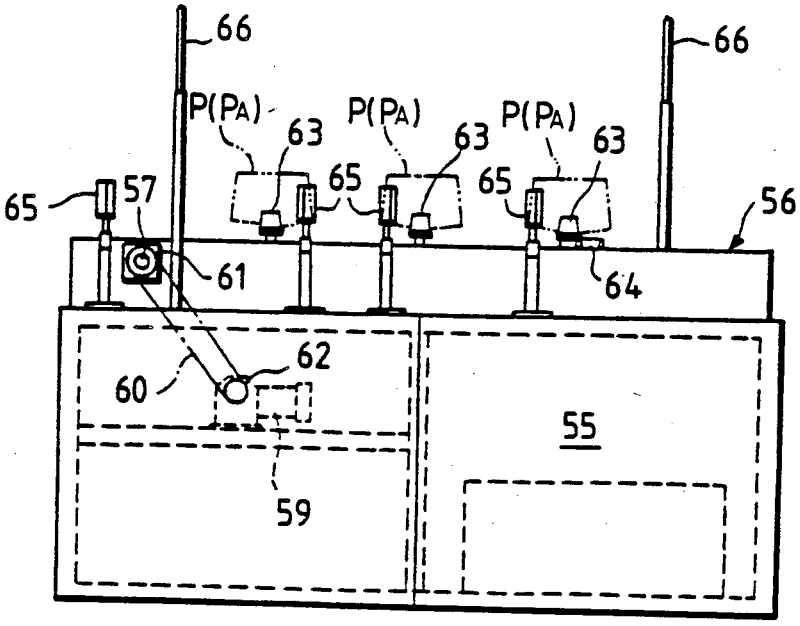
FIG. 7 is a rear elevational view of an aligning conveyor.

Subsequently, the aligning conveyor 5 to which a cone package P being turned over is transferred will be described. The aligning conveyor 5 is disposed just below the transfer position III in a direction perpendicular to the conveyor 4 on the winder 1 side. The aligning conveyor 5 includes, as shown in FIGS. 5 to 7, a belt travelling table 56 provided on a base 55 and an endless conveyor belt 58 extending at the opposite ends thereof between and round pulley shafts 57 such that a power may be transmitted from a motor 59 accommodated in the base 55 by way of a chain and sprocket mechanism 60, 61 and 62 to the endless conveyor belt 58 to cause the endless conveyor belt 58 to travel on the belt travelling table 56. Then, pegs 63 for fitting cone packages P thereon are provided projectingly in a predetermined spaced relationship on the conveyor belt 58.

It is to be noted that reference numeral 6 denotes a positioning sensor for stopping a peg 63 on the conveyor belt 58 at the transfer position III, and 65 a confirming sensor for detecting presence or absence of a cone package P fitted on a peg 63 on the aligning conveyor 10. Meanwhile, reference numeral 66 denotes a guide bar for guiding a vertically movable table of the overhead self-travelling truck 24 which travels just above the aligning conveyor 5.

With the package transfer device 6 having such a construction as described above, a cone package P in a horizontally lying posture $P_C$ transported to the conveyor carrying out end 4*a* can be held between and grasped by the chuck members 39 and 40 provided at the end portions of the arms 34 and 34 and can be transferred, while carrying out necessary posture changing, with certainty to a peg 63 on the aligning conveyor 5.

Inspecting Device

As for details of the inspecting device 11, a particular example of such device is disclosed in detail in the official gazette of Japanese Patent Laid-Open No. 62-39434 mentioned hereinabove.

Package Removing Device

The package removing device 15 for removing a cone package P from the stock conveyor 13 to the aligning conveyor 14 at the inspecting station 2 is constructed in the following manner.

Figure 8:
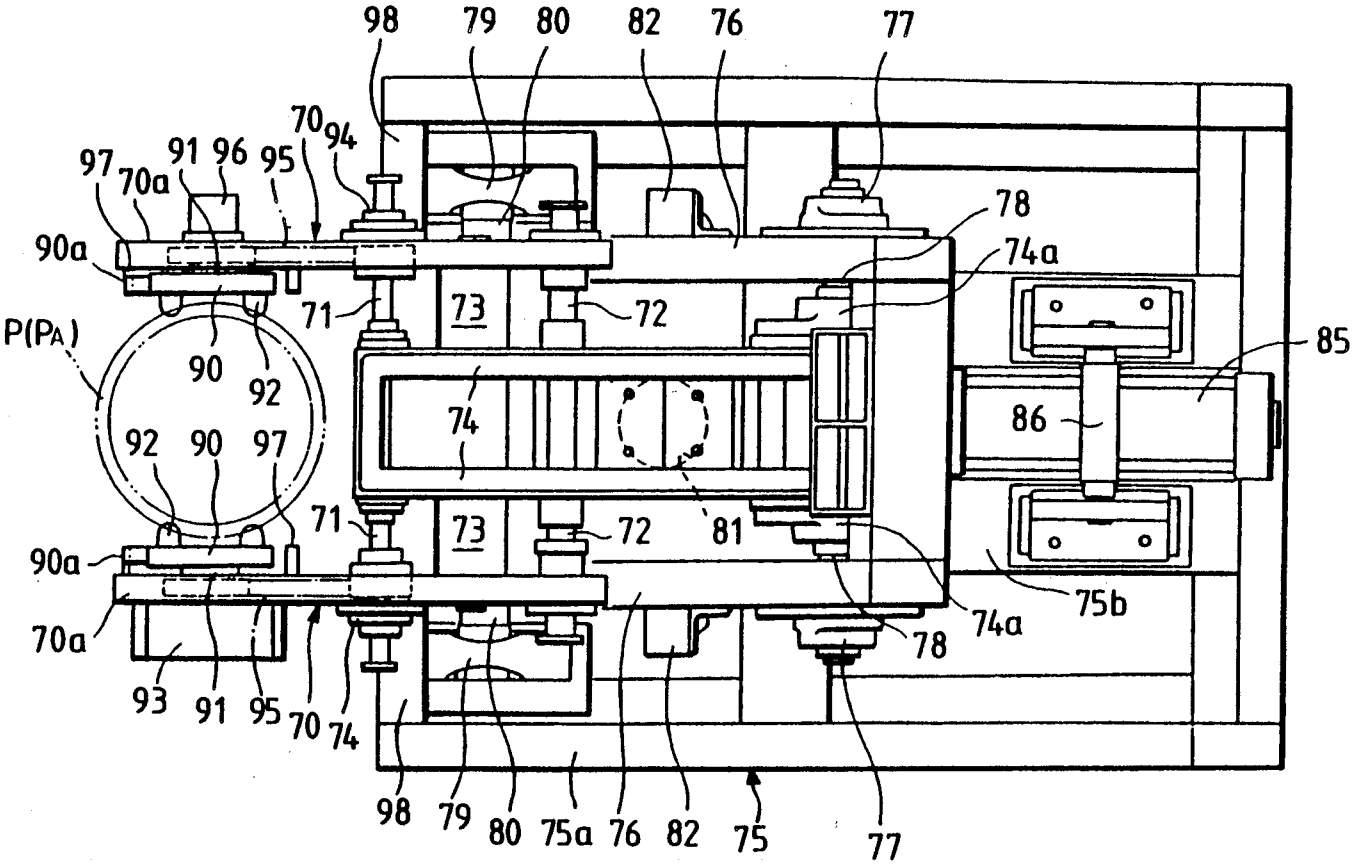
FIG. 8 is a plan view of a package removing device.
Figure 9:
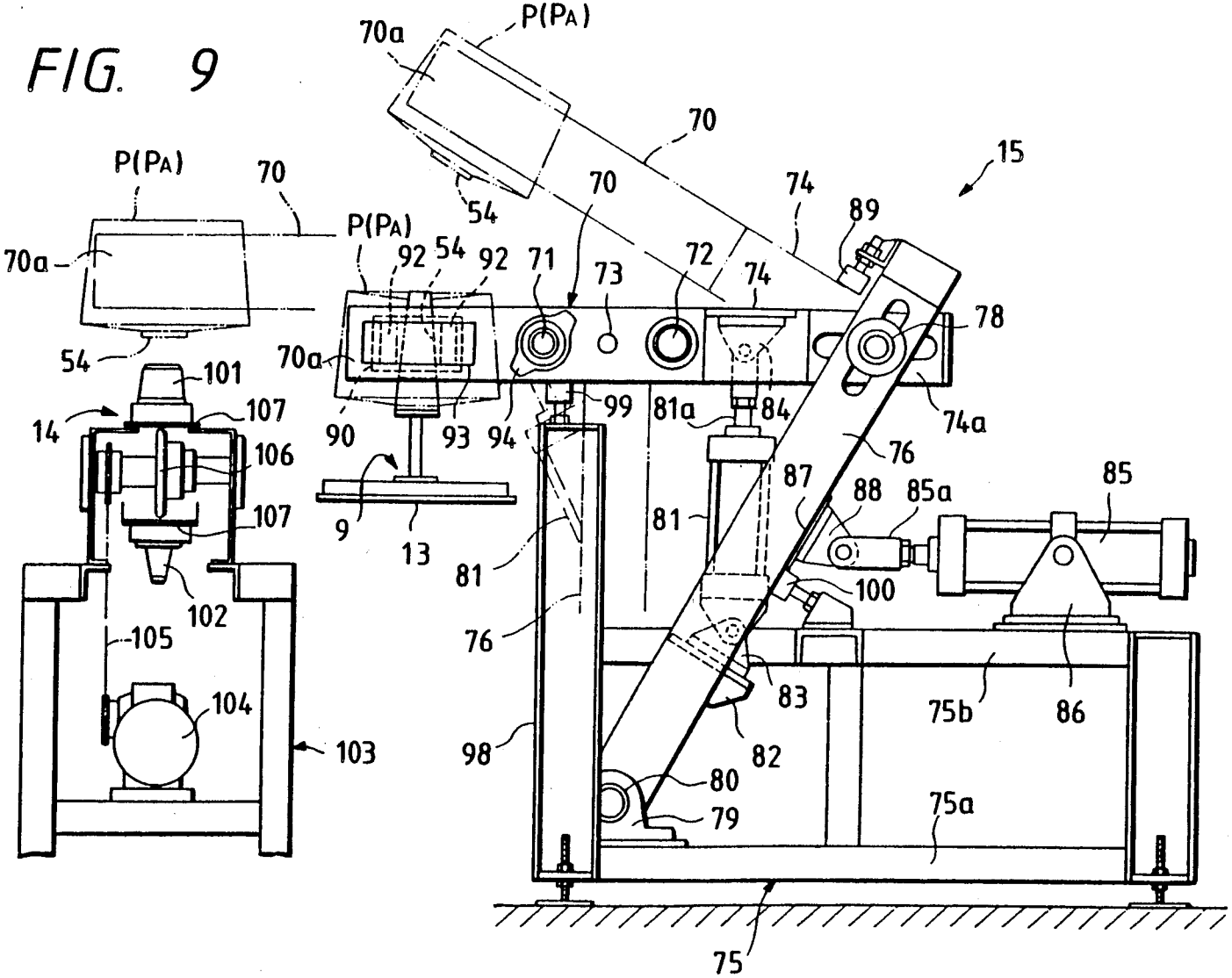
FIG. 9 is a side elevational view of the same.

FIGS. 8 and 9 show details of the package remove device 15 described hereinabove.

The present device includes a pair of operating arms 70 and 70 provided in a parallel opposing relationship to each other, guide shafts 71 and 72 extending in a perpendicular direction through the operating arms 70 and 70 on the base end side, and a cylinder 73 interposed between opposing faces of the guide shafts 71 and 72 for expanding and contracting movement in a widthwise direction to interconnect the guide shafts 71 and 72 for opening and closing movement of the distance between them. The operating arms 70 and 70 have a base frame 74 securely mounted thereon with the guide shafts 71 and 72 held therebetween, and the base frame 74 extends rearwardly. Then, the base frame 74 integrated with the operating arms 70 and 70 is supported at base end portions 74*a* and 74*a* thereof for pivotal motion around 78 by way of bearings 77 and 77 at upper end portions of support arms 76 and 76 which extend obliquely from a base 75. The support arms 76 and 76 are supported at lower end portions thereof for pivotal motion around 80 at a forward location of a lower frame 75*a* of the base 75 by means of bearings 79 and 79.

A cylinder 81 for expanding and contracting movement in upward and downward directions is interposed in an upright posture intermediately between the base frame 74 integrated with the operating arms 70 and 70 and the support arms 76 and 76. More particularly, a bracket 82 is mounted on inner faces of intermediate portions of the support arms 76 and 76, and the cylinder 81 is connected for rocking motion to the bracket 82 by way of a mounting member 83 while a cylinder rod 81*a* provided projectingly from the other end side of the cylinder 81 is connected for rocking motion to a mid portion of a lower face of the support frame 74 by means of a mounting member 84.

Meanwhile, a cylinder 85 for expanding and contacting movement in forward and backward directions is abutted with intermediate portions of the support arms 76 and 76. More particularly, the cylinder 85 is secured for rocking motion to a central location of an upper frame 75*b* of the base 75 by way of a mounting member 86 while a bracket 87 is mounted on rear end faces of intermediate portions of the support arms 76 and 76 and a cylinder rod 85*a* provided projectingly forwardly from the cylinder 85 is connected to the bracket 87 by way of a mounting member 88.

Based on such a construction as described above, the operating arms 70 and 70 can be opened and closed in distance between them by operation of the cylinder 73 while they are disposed for rocking motion in upward and downward directions and also for movement in forward and backward directions by way of the base frame 74 by operation of the cylinder 81 and the cylinder 85.

The pair of operating arms 70 and 70 described above have chuck members 90 and 90 individually supported at opposing end portions 70*a* and 70*a* thereof for rotation by means of support shafts 91 and 91 for grasping an outer periphery of a cone package P. The chuck members 90 have mounted thereon chuck pieces 92 and 92 which individually make pairs in forward and backward directions of inner faces in a spaced relationship by a distance corresponding to a size of a cone package P to be handled. Each of the chuck pieces 92 is chamfered so as to have an arcuate section and has a taper in a longitudinal direction corresponding to an outer conical peripheral face of a cone package P.

Then, as a rotating means for turning over the chuck members 90, a bidirectional rotary cylinder 93 is provided on an outer side of an end portion 70*a*, in this instance, of one of the operating arms 70 so that the support shaft 91 of the one chuck member 90 may be driven by the cylinder 93 to rotate the chuck member 90 within the range of 180 degrees in the opposite directions. Further, belts 95 and 95 are stretched between and around pulleys provided the support shafts 91 and 91 on the opposite sides and the guide shaft 71 (supported for rotation on the operating arms 70 and 70 by way of bearings 94 and 94), and using the belts 95 and 95 and the guide shaft 71 as a rotation transmitting mechanism, the support shaft 91 on the opposite side (supported on a bearing 96) is rotated to rotate the chuck members 90 and 90 on the opposite sides in a synchronized relationship. It is to be noted that reference numeral 97 denotes a stopper disposed on either side of each of the chuck members 90, and a side projection 90*a* of each of the chuck members 90 is abutted with the stopper 97 to limit forward and reverse turning over phases of the same.

The removing device 15 is constituted such that, when it is in an inoperative position indicated by solid lines in FIG. 9, a lower face of the base frame 74 abuts with a stopper 99 on a frame 98 provided uprightly at a front end portion of the base 75 so that the operating arms 70 and 70 are held in a horizontal posture. Meanwhile, the support arms 76 and 76 abut at rear end faces thereof with stoppers 100 and 100 provided projectingly obliquely upwardly from the upper frame 75*b* of the base 75 so that it is held stably in a predetermined inclined posture. Further, when the operating arms 70 and 70 are rocked up, a stopper 89 provided at the upper end portion of the support arm 36 defines the rocking angle of the operating arms 70 and 70.

It is to be noted that the aligning conveyor 14 to which the removing device 15 removes cone packages P has a common structure to the aligning conveyor 5 except a different point that it has implanted thereon pegs for fitting packages P thereon in an erect posture $P_A$ and pegs for fitting packages P thereon in an inverted posture $P_B$. In particular, a conveyor belt 107 is stretched around and circulated by a pulley 106 which is driven by way of a chain 105 by a motor 104 accommodated in a base 103, and erect pegs 101 and inverted pegs 102 having a tapering profile for fitting a cone package P in an inverted posture $P_B$ thereon are fixedly provided in a predetermined spaced relationship on the conveyor belt 107.

If the package removing device 15 having such a construction as described above is utilized, then a cone package P which is fitted in an erect posture $P_A$ on a tray 9 and transported on the stock conveyor 13 can be held between and grasped by the chuck members 90 and 90 provided for rotation at the end portions of the operating arms 70 and 70 and can be transferred with certainty to a peg 101 or 102 of the aligning conveyor 14 while maintaining its posture or after changing its posture freely into a turned over inverted posture $P_B$. Then, cone packages P transferred to the aligning conveyor 14 are successively fed to and aligned at a predetermined location by intermittent feeding of the aligning conveyor 14 synchronized with delivery of the packages P.

Chuck Device of Package Feeding Truck

In order to realize the system of the present invention, whether cone packages P aligned on the aligning conveyor 5 or 14 are in an erect posture or in an inverted posture, it is necessary to mount a chuck device which can mount and suspend one of such cone packages P and feed the cone package P onto a vertically movable table 110 which depends from the overhead self-travelling truck 24 which travels at an upper location of the system.

FIGS. 10 to 14 show a chuck device of the vertically movable table 110 which has been developed to achieve such an object as described above.

The vertically movable table 110 is constructed by framing an outer frame 111 into a square configuration and includes a support table 113 on parallel frames 112 and 112 extending horizontally at intermediate portions of the vertically movable table 110 in a longitudinal direction. Steel belts 115 depend from the overhead self-travelling truck 24 (not shown) positioned above and are fixedly held at lower ends thereof on brackets 114 and 114 erected on the support table 113 so that the vertically movable table 110 may be provided uprightly for lifting and falling movement by a winding operation and an unwinding operation of the belts 115.

From the vertically movable table 110, three rotary shafts 116 disposed in an equally spaced relationship on the center line in the longitudinal direction depend for rotation while being supported for rotation by bearing members 117 individually secured to a lower face 110*a* of the vertically movable table 110. The distance between axes of the three rotary shafts 116 is made coincident with the package loading pitch h when cone packages P mounted and suspended on the vertically movable table 110 are palletized.

Each of the rotary shafts 116 has a basically common construction. Thus, description will be given taking notice of the centrally positioned rotary shaft 116. The rotary shaft 116 has a disk-like pulley 118 provided fixedly around an axis thereof. Meanwhile, a motor 119 is carried on the support table 113, and a pulley 120 is provided fixedly on a motor shaft 119*a* depending from the motor 119. Thus, a timing belt 121 is stretched between and around the pulley 118 and the pulley 120 disposed at horizontal positions so that a torque may be transmitted from the motor 119 by way of the belt 121 to rotate the rotary shaft 116 in either of normal and reverse directions. It is to be noted that, in this instance, in order to restrict the phase of rotation of the rotary shaft 116 within the range of about 90 degrees, a pivotal bar 122 is provided projectingly at an upper end portion of the rotary shaft 116 while limit switches 123 and 123 are provided on the support table 113 such that the pivotal bar 122 may abut with one of the limit switches 123 and 123 at either of limit angles.

Figure 12:
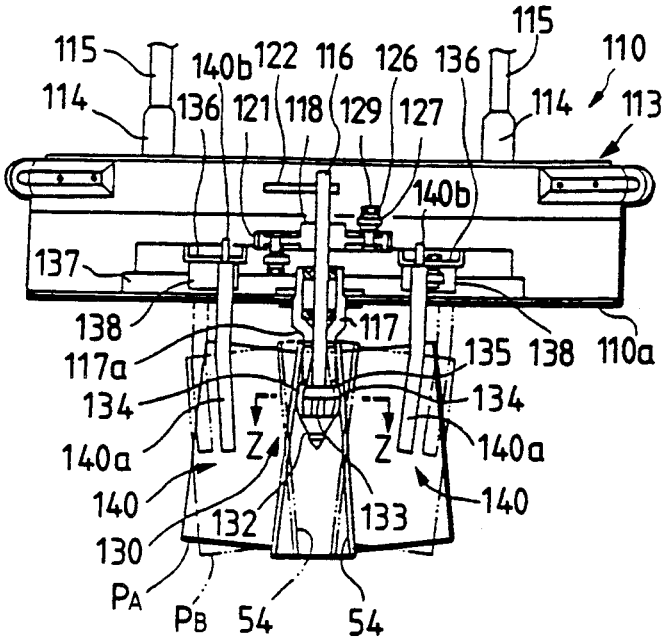
FIG. 12 is a horizontal sectional view of the same.
Figure 14:
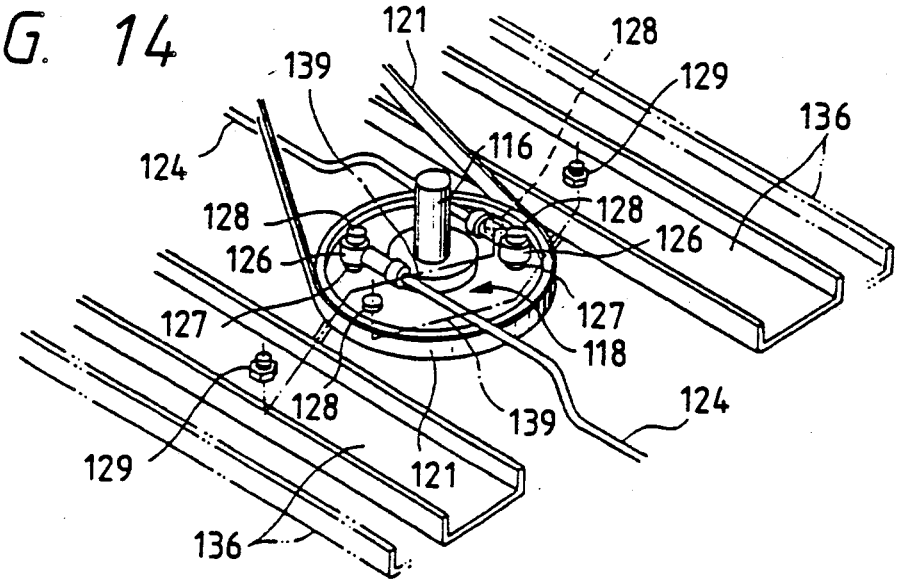
FIG. 14 is a perspective view of essential part of FIG. 10.
Figure 15:
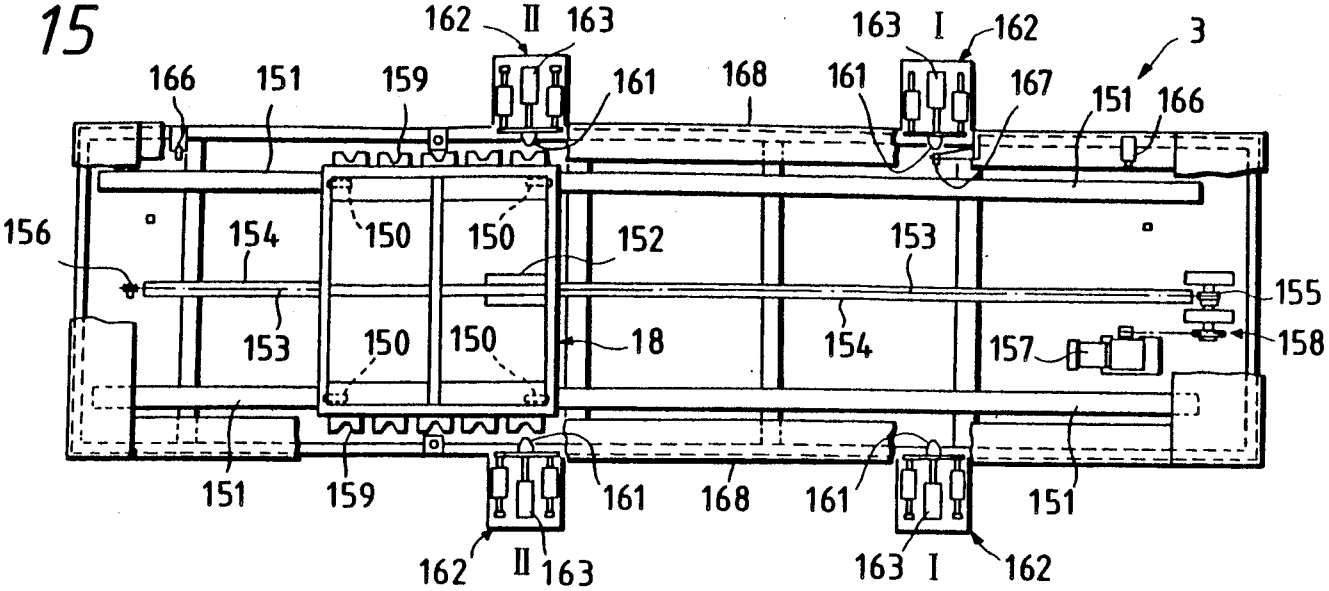
FIG. 15 is a plan view of a pallet placing truck.

The rotary shafts 116 positioned on the opposite sides of the central rotary shaft 116 which is rotated in such a manner as described above are rotated in a synchronized relationship individually by way of link/ levers. In particular, a pair of parallel links 124 and 124 are disposed, and one ends of them are connected for pivotal motion to the upper face side of the pulley 118 at opposing locations while the other ends of them are connected for pivotal motion to rocking levers 125 and 125 connected to the rotary shafts 116 and 116 on the opposite sides so that rotational motion of the pulley 118 may be transmitted to the rotary shafts 116 and 116 on the opposite sides by way of crank mechanisms. It is to be noted that details of a connecting structure of a parallel link 124 to the pulley 118 (or rocking lever 125) are shown in FIGS. 12 and 14. In particular, a structure is employed wherein a pin shaft 128 extends through a shaft hole of a rod end 126 securely mounted at an end portion of each of the parallel links 124 with a color 127 interposed therebetween and a nut 129 is screwed to a projected end of the pin shaft 128.

A common first chuck member 130 is provided at a lower end portion of each of the three rotary shafts 16 which depend from the lower face 110*a* of the vertically movable table 110 in this manner. The first chuck member 130 will be described in detail with reference to FIGS. 11 and 12.

Figure 13:
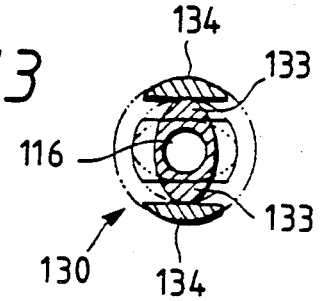
FIG. 13 is a sectional view taken along line Z—Z of FIG. 12.

A lower end portion 117*a* of a bearing member 117 which supports a rotary shaft 116 for rotation thereon extends downwardly while being drawn to a small diameter sufficient to be fitted into an axial hole (paper pipe) 54 of a cone package P to be handled. Here, the axial hole 54 of a cone package P has a taper corresponding to a yarn layer package wound on an outer periphery thereof. Meanwhile, a cone-like head 132 is mounted at an end of the rotary shaft 116 depending from the lower end of the bearing member 117, and an elliptic cam 133 is fixedly provided on the rotary head 116 above the head 132. Then, a pair of engaging levers 134 depend on the opposite sides of the elliptic cam 133 with upper ends thereof supported for pivotal motion at the lower end portion 117*a* of the bearing member 117 described above. The engaging levers 134 and 134 are held on the opposite sides of the elliptic cam 133 with annular springs (not shown) fitted in horizontal grooves 135 formed at middle upper portions thereof, and the outer diameter thereof is expanded and contracted as shown in FIG. 13 following the phase of rotation of the elliptic cam 133 on the inside.

Subsequently, second chuck members 140 disposed around the first chuck member 130 will be described.

Figure 10:
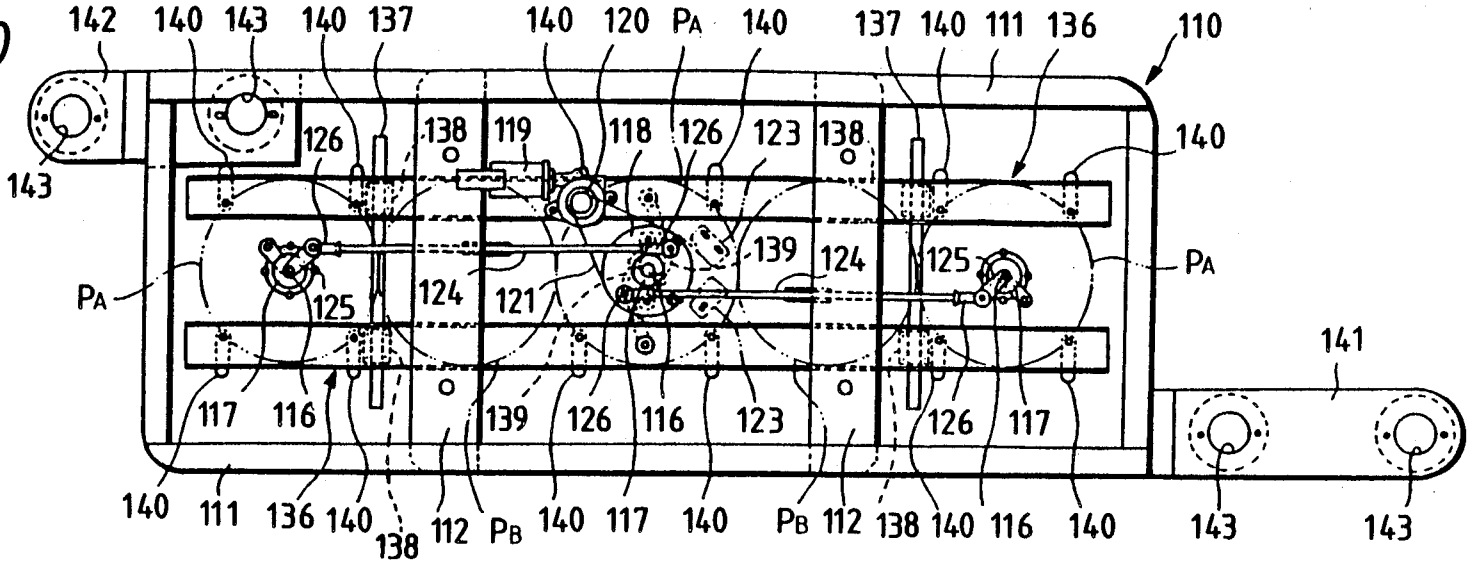
FIG. 10 is a cutaway plan view of a vertically movable table depending on a package feeding truck.

A pair of front and rear conduit-like movable frames 136 extending in the longitudinal direction of the vertically movable table 110 are disposed below the opposite sides of the pulley 118 disposed at a central location of the vertically movable table 110. Guide rods 137 and 137 mounted horizontally on the opposite sides of the vertically movable table 110 are held on receiving members 138 and 138 provided fixedly on the lower face of the vertically movable table 110 so that the individual movable frame 136 are mounted for sliding movement in lateral directions. Then, a pair of links 139 and 139 having an L-shape in plan are extended between lower faces of the movable frames 136 and 136 and a lower face of the pulley 118 as shown in FIGS. 10 and 14 so that the pair of movable frames 136 and 136 may be moved toward and away from each other in an interlocking relationship with rotation of the pulley 118 on the opposite sides of the pulley 118. It is to be noted that a connecting structure of each of the L-shaped links 139 to the pulley 118 (or a movable frame 136) is similar to that for the parallel link 124 described hereinabove.

From the movable frames 136 and 136 disposed for movement toward and away from each other on the opposite sides of the pulley 118 in this manner, a sum total of four, two for each side, package grasping rods 140 depend around each of the rotary shafts 116. In this instance, a set of four such grasping rods 140 constitute a second chuck member Each of the grasping rods 140 has a base end small diameter portion 140*b* which extends from below through a movable frame 136 and is secured with a nut (not shown) screwed from above to the base end small diameter portion 140*b* thereof. The arrangement of the four grasping rods 140 depending around each of the rotary shafts 116 corresponds to a size of a cone package P to be handled, and an end portion 140*a* of each of the grasping rods 140 has an inward taper corresponding to an outer conical peripheral face of a cone package P.

Figure 11:
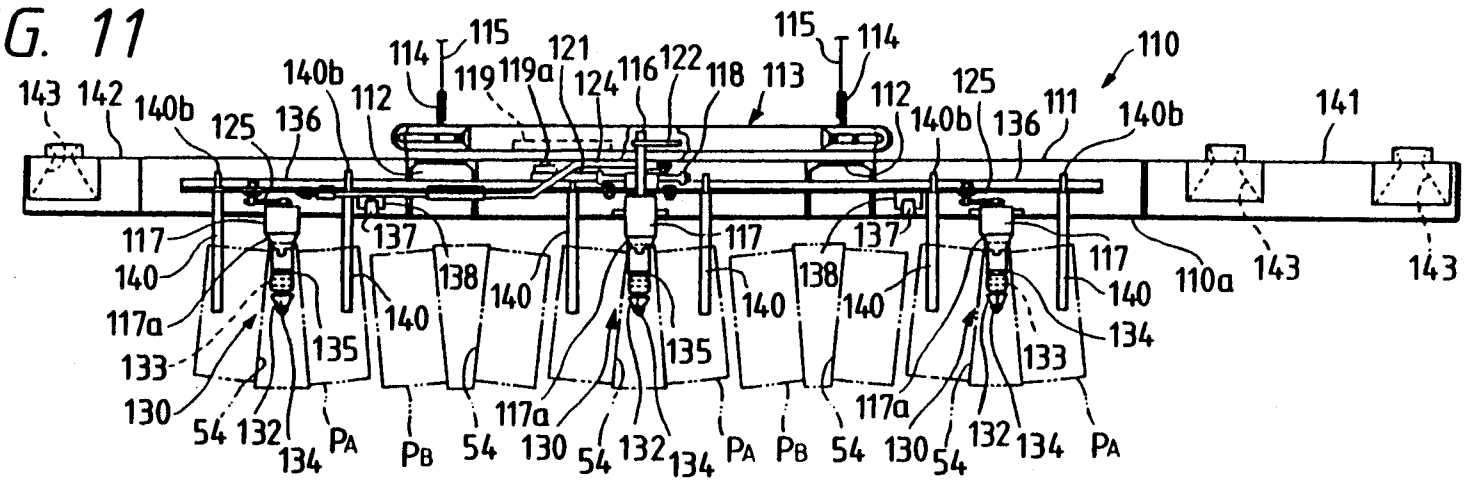
FIG. 11 is a vertical sectional view of the same.

Referring to FIGS. 10 and 11, reference numerals 141 and 142 denote guide pieces which are provided projectingly in the opposite directions from the outer frame 111 on the opposite sides of the vertically movable table 110 in the longitudinal direction, and two guide holes 143 and 143 are opened in a predetermined spaced relationship in the front guide piece 141 while two guide holes 143 and 143 are opened in the same spaced relationship in the rear guide piece 142 and an adjacent portion of a body of the vertically movable table Those guide holes 143 guide bars (not shown) erected upright from the floor at a stopping position of the overhead self-travelling truck 24 to position the vertically movable table 110 at a lifting and falling position without an error. It is to be noted that the reason why two such guide holes 143 and 143 are provided at each of forward and backward locations is that it is intended to change the lifting and falling position of the vertically movable table 110 depending upon whether three cone packages P or two cone packages P are to be mounted on the vertically movable table 110.

With the chuck device having such a construction as described above, by rotating the rotary shaft 116 forwardly and reversely from the motor 119 by way of the pulley 118, a cone package P can be mounted with certainty by a same operation whether it is in an erect posture or in an inverted posture In particular, if the rotary shaft 116 is rotated after it is inserted into the axial hole 54 of a package P, where the package P is an erect package, the first chuck member 130 which is increased in diameter by the elliptic cam 133 holds the axial hole 54, but where the package P is an inverted package, the second chuck member 140 depending from one of the movable frames 136 interlocked with the same makes an approaching operation to grasp an outer periphery of the package. Then, when one of them operates, the other moves but in vain depending upon inner and outer configurations peculiar to the cone package P. Accordingly, if such a chuck device is carried on the vertically movable table 110, then a function required for the overhead self-travelling truck 24 is satisfied.

Pallet Placing Truck

The pallet placing truck 18 is constructed such that it can be moved intermittently at the predetermined pitch h in a direction perpendicular to the direction of travelling movement of the truck 24 in order to load cone packages P mounted and suspended on the overhead self-travelling truck 24 in alternately opposite postures onto the pallet placing truck 18.

FIGS. 15 to 18 show details of the pallet placing truck 18.

The truck 18 is disposed for movement in a direction perpendicular to the direction of travelling movement of the overhead travelling truck 24 at the palletizing station 3 described hereinabove. In particular, wheels 150 supported for rotation at four corners of a lower portion of the truck 18 by way of brackets ride on travelling rails 232 and 232 fixedly provided on support legs 230 and 230 on the floor so that the wheels 150 may be moved back and forth freely on the travelling rails 151 and 151.

The truck 18 is connected, at a connecting portion 152 provided at a front lower portion of a framed frame, to the opposite ends of an endless chain 153 which is circulated in parallel to the travelling rails 151 so that the truck 18 may be pulled to travel by the chain 153. The chain 153 is installed along upper and lower portions of a chain guide 154 disposed between the travelling rails 151 and 151 and is stretched between and around sprocket wheels 155 and 156 supported for rotation at the opposite end portions of the guide 154. Then, a power is transmitted from the motor 157 to one 155 of the sprocket wheels by way of a speed reducing gear 158 so that the chain 153 is driven to circulate in the forward or backward direction while the truck 18 is pulled to move in the forward or backward direction by the chain 153.

A plurality of projection engaging members 160 each having a wedge-shaped recessed portion 159 are fixedly provided on the opposite sides of the truck 18. The projection engaging members 160 are provided at a distance and by a number corresponding to the pitch h and the arranged number of cone packages P loaded as illustratively shown in FIG. 4 on the pallet 20 placed on the truck 18. It is desirable that the projection engaging member 160 is made of resilient materials.

Meanwhile, cone-like projections 161 for individual fitting engagement with the wedge-shaped recessed portions 159 described above are provided projectingly at the positions I and II on the opposite sides of the truck 18. The cone-like projections 161 are connected by way of support plates 164 to cylinder rods 163*a* of cylinders 163 installed on bases 162 disposed on the opposite sides of the truck 18 so that they are moved back and forth perpendicularly to the direction of travelling movement of the truck 18 in an interlocking relationship to expanding and contracting movement of the cylinder rods 163*a*. Then, expansible guide rods 165 provided in a juxtaposed relationship on the opposite sides of the cylinders 163 are connected to the support plates 164 so that the cone-like projections 161 may be supported on the bases 162 without a play.

It is to be noted that the position I at which the cone-like projections 161 paired on the opposite sides are installed corresponds to a loading stopping position for cone packages P by the overhead self-travelling truck 22 while the installation position II corresponds to a loading stopping position for a pallet 20 by the travelling overhead truck 22.

Figure 18:
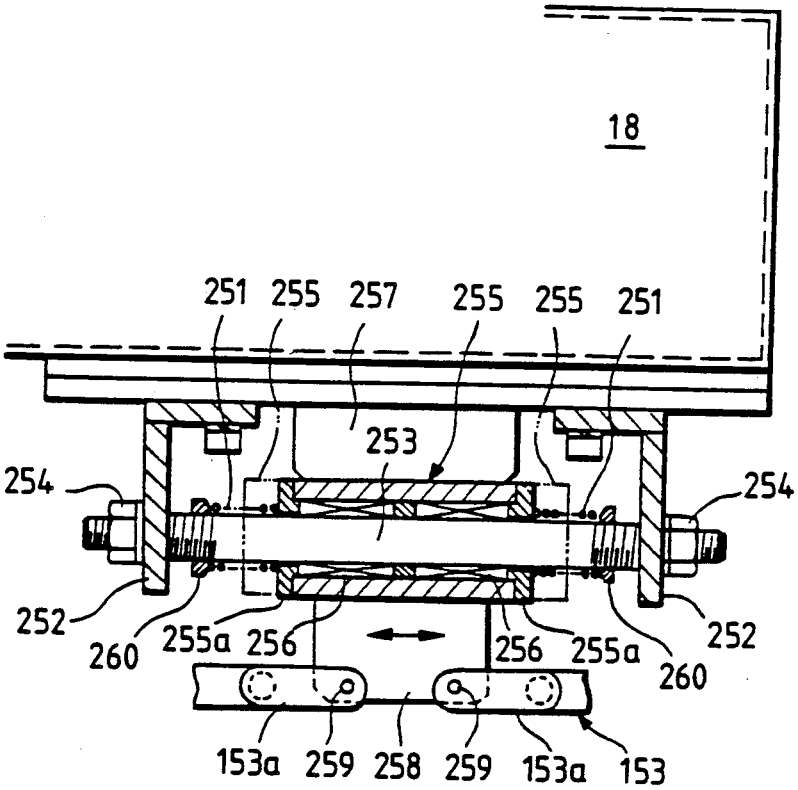
FIG. 18 is a vertical sectional view of FIG. 17.

The pallet placing truck 18 has such a construction as described so far, and at the connecting portion 152, the chain 153 is connected to the truck 18 by way of a spring 251. Details of the connecting structure are shown in FIG. 18. In particular, a pair of front and rear brackets 252 and 252 depend at a front lower portion of the truck 18, and a support shaft 253 is supported between the brackets 252 and 252 in parallel to the chain 153 with the opposite ends thereof fastened to the brackets 252 and 252 by nuts 254 and 254. A sliding tubular body 255 is fitted for sliding movement around the support shaft 253 by means of bearings 256 and 256. Then, a sliding guide 257 provided projectingly from a lower face of the truck 18 is abutted with the sliding tubular body 255, and a connecting piece 258 is extended downwardly in an integral relationship from the sliding tubular body 255. The endless chain 153 is mounted at the opposite end portions 153*a* and 153*a* thereof for pivotal motion at 259 on the connecting piece 258. Meanwhile, spring receiving nuts 260 and 260 are screwed onto and positioned at locations adjacent the opposite end portions of the support shaft 253 which holds the sliding tubular body 255 thereon, and the spring 251 is interposed in a compressed condition between an end plate 255*a* of the sliding tubular body 255 and each of the receiving nuts 260. Thus, the truck 18 is connected to the chain 153 by way of the substantially expansible springs 251 and 251.

It is to be noted that, in the drawings, reference numerals 166 and 167 denote non-contact sensors provided projectingly from side covers 168 provided uprightly on the opposite sides of the travelling rail 151, and the non-contact sensors 166 and 167 detect a marker 264 applied to the truck 18 and output a stopping signal to a drive system.

Subsequently, operation of the pallet placing truck 18 will be described.

Figure 16:
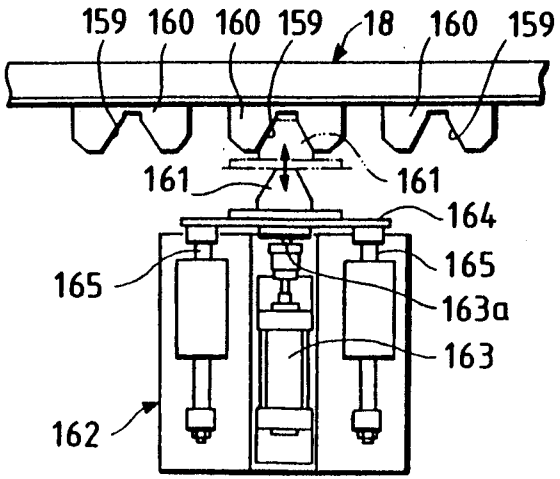
FIG. 16 is an enlarged view of essential part.
Figure 17:
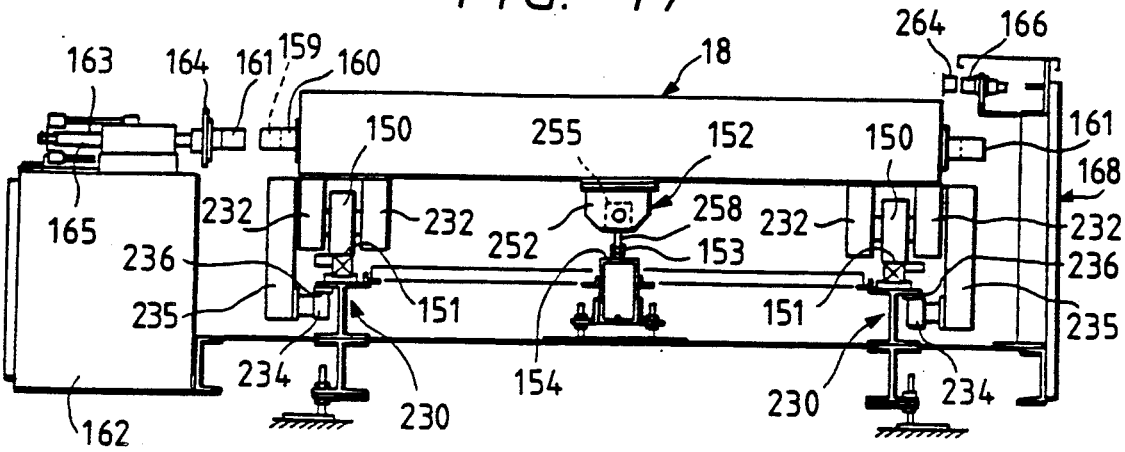
FIG. 17 is a front elevational view of the truck.

The truck 18 is pulled to move and travel by the chain 153, and when it is to be stopped, the driving of the chain by the motor 157 is switched off and the cylinders 163 disposed on the bases 162 on the opposite sides are rendered operative to advance the cone-like projections 161 until they are fitted into the wedge-shaped recessed portions 159 opened to the opposing projection engaging members 160 (alternate long and two short dashes lines in FIG. 16). In this instance, even if the center lines of them do not coincide with each other due to inertia or a braking error of the truck 18, end portions of the cone-like projections 161 to be fitted compulsorily are guided along inclined faces of the wedge-shaped recessed portions 159 so that a centering action to correct a positional displacement between them takes place automatically. Meanwhile, with regard to a displacement of the projection engaging members 160 having the wedge-shaped recessed portions 159, that is, with regard to a displacement of the truck 18, a tensile force of the chain 153 which is stretched in a taut condition for pulling the truck 18 acts so as to restrict free movement of the truck 18. However, since the truck 18 is connected to the chain 153 by way of the springs 251 and 251 as described hereinabove, relative movement between them is permitted by a distance corresponding to a displacement over which the springs 251 and 251 are deformed (alternate long and two short dashes lines in FIG. 18). Therefore, if the cone-like projections 161 are fitted into the wedge-shaped recessed portions 159 of the truck 18, then the truck 18 is automatically converged to a predetermined stopping position and is engaged from movement in the condition.

Accordingly, if a required number of wedge-shaped recessed portions 159 are provided in a spaced relationship by a distance corresponding to a loading pitch of cone packages P on the opposite sides of the truck 18, then an accurate intermittently moving operation is carried out simply and with certainty by a mechanical engaging clutch mechanism for the cone-like projections 161 even without providing a separate control system for the positioning and stopping of the truck 18. In other words, a pallet placing truck having a very simple construction can be provided as a pallet placing truck which travels at a fixed pitch, which is required for the realization of the palletizing system shown in FIG. 1.

It is to be noted that a pallet placing truck mentioned above has a peculiar utility value for an application wherein a truck must necessarily be fed intermittently in addition to the case wherein it is utilized in the system shown in FIG. 1. In this instance, the arrangement and the mounting structure of the wedge-shaped recessed portions and the cone-like projections are modified suitably in accordance with an object of application. Further, as for a mechanism for interconnecting the truck and the chain by way of the spring and so forth, it is possible to employ a different connecting structure from that described above only if a necessary centering action upon stopping is assured.

As described so far, a pallet placing truck of the present invention is characterized in that, since cone-like projections are engaged with wedge-shaped recessed portions provided on the opposite sides of the truck and a pulling chain is connected to the truck by way of a spring, positioning and stopping when the truck is to be intermittently moved can be achieved accurately be engagement of the cone-like projections with the wedge-shaped recessed portions, and the pallet placing truck can be constructed simply without the necessity of a separate control system.

Chuck Device of Pallet Feeding Truck

Figure 19:
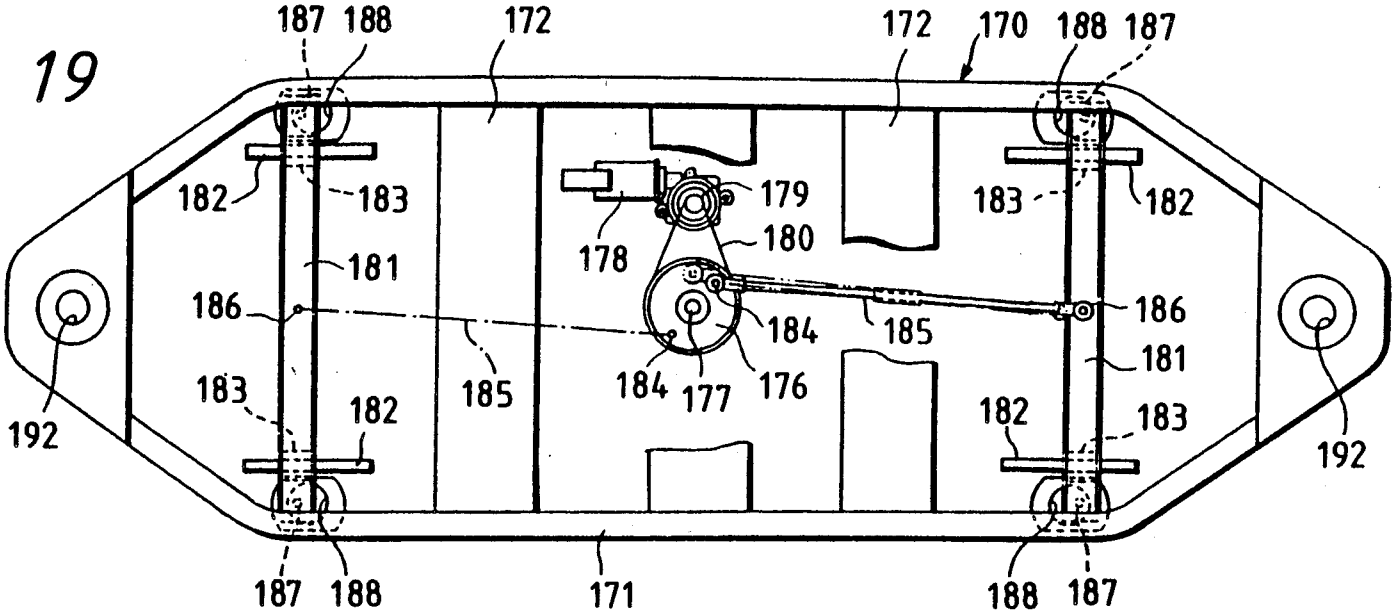
FIG. 19 is a cutaway plan view of a vertically movable table depending on a pallet feeding truck.
Figure 20:
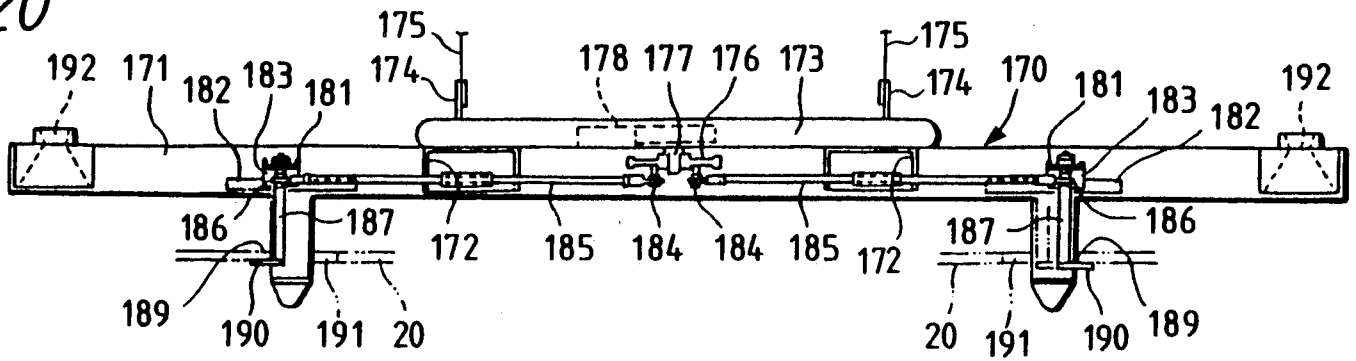
FIG. 20 is a vertical sectional view of the same.

The overhead self-travelling truck 22 for loading a pallet 20 from the pallet placing table 19 to the pallet placing truck 18 has a chuck device carried thereon for mounting and suspending a pallet 20 on a vertically movable table 170. An example of construction of the chuck device is shown in FIGS. 19 and 20.

The vertically movable table 170 is constructed by framing an outer frame 171 into a ship-like configuration and includes a support table 173 fixedly provided on parallel frames 172 and 172 provided horizontally at intermediate portions of the vertically movable table 170 in a longitudinal direction. Stale belts 175 depend from the overhead self-travelling truck 22 (not shown) positioned above and are fixedly held at lower ends thereof on brackets 174 and 174 erected on the support table 173 so that the vertically movable table 170 may be provided uprightly for lifting and falling movement by a winding operation and an unwinding operation of the belts 175.

At a central location of the vertically movable table 170, a pulley 176 which is rotated in a horizontal posture is supported for rotation on the support table 173 by way of a support shaft 177. Meanwhile, a motor 178 is carried on the support table 173, and a timing belt 180 is stretched between and around a motor pulley 179 of the motor 178 and the pulley 176 described above so that the pulley 176 may be rotated forwardly and reversely.

In the meantime, a pair of movable frames 181 and 181 are provided horizontally on the opposite sides of the vertically movable table 170. Each of the movable frames 181 is supported at the opposite end portions thereof for sliding movement on guide rods 182 and 182, which are fixedly provided in a perpendicular direction, by way of receiving members 183 and 183 which hold the guide rods 182 thereon. Then, parallel links 185 and 185 are connected at one ends thereof for pivotal motion to symmetrical locations 184 and 184 of a lower face of the pulley 176 and connected at the other ends thereof for pivotal motion to central portions 186 and 186 of the movable frames 181 and 181 so that the movable frames 181 and 181 may be moved in the longitudinal direction toward and away from each other at a fixed stroke in accordance with a phase of rotation of the pulley 176.

Rods 187 and 187 depend individually from the opposite end portions of each of the movable frames 181 described hereinabove. Each of the rods 187 is accommodated in the inside of one of tube leg members 188 fixedly provided at four corners of a lower face of the vertically movable table 170, and an engaging claw 190 which is projected from or retracted into a window hole 189 of the tube leg member 188 is provided projectingly on each of the movable frames 181.

It is to be noted that reference numeral 192 denotes a guide hole opened at an pointed end portion on either side of the vertically movable table 170, and the guide hole 192 guides a guide bar (not shown) erected uprightly on the floor to position the vertically movable table 170 to a pallet loading position without an error.

With the chuck device having such a construction as described above, if the pulley 176 is rotated to operate the movable frames 181 so as to move the movable frames 181 away from each other, then the engaging claws 190 of the rods 187 are projected from the tube leg members 188 and engaged with mounting holes 91 of a pallet 20 so that the pallet 20 can be mounted and suspended stably. On the other hand, if the pulley 176 is rotated reversely, the engaging claws 190 of the rods 187 are retracted into the tube leg members 188 so that the pallet 20 can be released, and the pallet 20 can be transferred freely by such operations.

A palletizing system according to the present invention can be operated smoothly in its entire system by incorporating therein such system elements as listed hereinabove.

As described in detail so far, since a package palletizing system of the present invention is constituted such that feeding of cone packages to a palletizing station and loading of packages onto a pallet at the same station by dense filling are carried out making use of an overhead self-travelling truck for feeding cone packages from a winder to an inspecting station, simplification of feeding lines can be achieved comparing with an existing system, and besides a simple and rational system can be built which does not require installation of a complicated boxing robot.

What is claimed is:

1. A chuck device for a package feeding truck which is carried on a vertically movable table depending for lifting and descending movement on an overhead self-travelling truck comprising:

a rotary shaft depending from said vertically movable table, a first chuck member mounted on the rotary shaft and capable of being expanded and contracted in response to rotation of the rotary shaft a pair of movable frames disposed on the vertically movable table and being movable toward and away from each other in response to rotation of the rotary shaft, by means operatively connected to the rotary shaft and at least one of the movable frames, and a second chuck member depending form said movable frames and disposed about the first chuck member.

* * * * *